US006405551B1

(12) United States Patent
Kuwabara et al.

(10) Patent No.: US 6,405,551 B1
(45) Date of Patent: Jun. 18, 2002

(54) HEATING APPARATUS HAVING REFRIGERATION CYCLE

(75) Inventors: Katumi Kuwabara; Junji Wakikawa; Mitiyuki Takahashi; Akihiro Kobayashi, all of Saitama (JP)

(73) Assignee: Science, Inc., Saitama (JP)

( * ) Notice: Subject to any disclaimer, the term of this patent is extended or adjusted under 35 U.S.C. 154(b) by 0 days.

(21) Appl. No.: 09/574,258

(22) Filed: May 19, 2000

(30) Foreign Application Priority Data

May 20, 1999 (JP) ..... 11-139409
Nov. 12, 1999 (JP) ..... 11-321979

(51) Int. Cl.[7] ..... F25B 27/00

(52) U.S. Cl. ..... 62/238.7; 62/434; 62/318; 62/319; 62/238.6; 62/324.3

(58) Field of Search ..... 62/434, 318, 319, 62/238.6, 324.3, 238.7

(56) References Cited

U.S. PATENT DOCUMENTS 5,207,761 A * 5/1993 Ruff ..... 62/124
5,400,619 A * 3/1995 Husseiny et al. ..... 62/535
5,517,829 A * 5/1996 Michael ..... 62/277
5,536,411 A * 7/1996 Blades ..... 210/638
5,553,459 A * 9/1996 Harrison ..... 62/93
5,766,453 A * 6/1998 Morellato et al. ..... 210/143
6,044,903 A * 4/2000 Heilman et al. ..... 165/263
6,168,723 B1 * 1/2001 Moody ..... 210/774
6,207,046 B1 * 3/2001 Yamashita et al. ..... 210/138

FOREIGN PATENT DOCUMENTS

JP 6-48893 7/1994
JP 7-185574 7/1995

* cited by examiner

*Primary Examiner*—William Doerrler
*Assistant Examiner*—Mark Shulman
(74) *Attorney, Agent, or Firm*—Armstrong, Westerman & Hattori LLP

(57) ABSTRACT

A heating apparatus having a refrigeration cycle includes a compressor, a condenser and an evaporator. The heating apparatus has a first heat exchanger and a second heat exchanger, where the first heat exchanger is selected as a heat source, and the second heat exchanger is selected as either a cooling or heating source. The first heat exchanger and the second heat exchanger are connected in series with each other in a refrigerant circuit. A heating medium is circulated in a heat transfer device which is connected to the first heat exchanger. Bathwater of a bathtub and water of a hot-water storage tank are heated through the heat transfer device indirectly by the first heat exchanger.

10 Claims, 8 Drawing Sheets

HEATING APPARATUS HAVING REFRIGERATION CYCLE

FIELD OF THE INVENTION

The present invention relates to a heating apparatus having a refrigeration cycle which includes a compressor, a condenser and an evaporator, and more particularly to a heating apparatus having a refrigeration cycle, which is capable of cooling and heating as well as supplying hot water.

BACKGROUND OF THE INVENTION

A heating apparatus comprising a compressor, a condenser, an expansion valve, an evaporator and the like having a refrigeration cycle is well known. In addition, heat pumps are also well known. In a heating apparatus, upon activating the compressor, a refrigerant through the condenser, the expansion valve, the evaporator and the like, which allows the refrigerant to be changed in its state from liquid to gas at the condenser and from gas to liquid at the evaporator. The generated heat is then released outside by the condenser, while an external heat is absorbed by the evaporator. Thus, the condenser and the evaporator can serve as a heat source and a heat sink, respectively. A cooling/heating/hot-water supply apparatus applying such a refrigeration cycle has been widely known. As exemplarily shown in FIG. 9, this apparatus comprises a compressor 200 for compressing a refrigerant, a condenser or hot-water supply heat exchanger 201 for preparing hot water with a high-temperature refrigerant transferred from the compressor 200, and a cooling/heating heat exchanger 202 acting as a condenser for heating and as an evaporator for cooling, and a heat source heat exchanger 203 acting as a condenser for heating and as an evaporator for cooling. In FIG. 9, reference numbers 204, 205, 206, 207 and 208 indicate a cooling fan, a four-way switching valve, an expansion valve, a check valve, and a room heat exchanger, respectively. Thus, heating, cooling, and both hot water supply and cooling can be achieved by controlling the flow direction of the refrigerant as follows. In heating use, the four-way switching valve 205 is switched to allow the refrigerant to flow from the compressor 200 to the cooling/heating heat exchanger 202. The refrigerant then flows through the hot-water supply heat exchanger 201 into the cooling/heating heat exchanger 202. Water serving as the refrigerant is heated by the cooling/heating heat exchanger 202, acting as a condenser, and is then supplied into the room heat exchangers 208, 208 to provide indoor heating, as is widely known. In cooling use, the four-way switching valve 205 is switched to allow the refrigerant going out of the compressor 200 to flow to the heat source heat exchanger 203. The refrigerant passes through the hot-water supply heat exchanger 201 and then flows from the heat source heat exchanger 203 into the cooling/heating heat exchanger 202. In this case, the cooling/heating heat exchanger 202 acts as an evaporator so that the water refrigerated by the cooling/heating heat exchanger 202 is supplied into the room heat exchanger 208 to provide indoor cooling.

In hot-water supply use, the four-way switching valve 205 is switched to allow the refrigerant to flow to the hot-water supply heat exchanger 201. The refrigerant is then condensed at the hot-water supply heat exchanger 201. When cold water is supplied from a city water pipe 210 to the hot-water supply heat exchanger 201, the water is heated by the hot-water supply heat exchanger 201 and is then discharged from a tapping-water pipe 211. When cooling is performed in parallel with hot water supply, the four-way switching valve 205 is switched to allow the refrigerant to flow from compressor 200 to both the hot-water supply heat exchanger 201 and the heat source heat exchanger 203. The refrigerant is then condensed at the hot-water supply heat exchanger 201 so that hot water may be supplied as described above, and the refrigerant is simultaneously evaporated at the hot-water supply heat exchanger 201 so that indoor cooling may be provided as described above.

Thus, the conventional refrigeration cycle or heat pump is capable of providing both cooling/heating and hot water supply by a single unit. In addition, the conventional refrigeration cycle is economical as compared with hot water supplies using other heat sources, such as electricity or gas fuel. However, the conventional cooling/heating/hot-water supply apparatus is only available for cooling/heating and hot water supply. Moreover, it is only difficult to determine if the potential efficiency of the refrigeration cycle is fully brought out and utilized in the conventional apparatus. There is also the problem that the water temperature obtained from the conventional heat pump is less than 55° C. which is insufficient for tap water. It is expected that the tap water temperature could be raised in some measure by increasing the condensing pressure of the heat pump, for example, up to 2.2MPa or more. However, when the condensing pressure is increased, the compressor is imposed to operate under severe conditions, and pressure differential between lower and upper pressures in operation is disadvantageously large. In addition, a safety device is applied to most machines in order to prevent an operation under high pressure. Thus, the operating pressure is limited, for example not more than 2.75MPa, resulting in tap water 55° C. In a conventional heat pump capable of preparing hot water instantaneously, tap of 60° C. or more can be obtained. However, the temperature of the water supplied to the hot-water supply heat exchanger ranges from 0–35° C., thus the heat pump is inefficient because such a heat pump cannot reheat the water to 55° C. right after use. Under the reasons described above, regardless of system types, such as an instantaneous system and a circulating system, the conventional cooling/heating/hot water supply apparatus has a problem with difficulty of use as a heat source for air conditioning and floor heating, or a heat source for drying and the like.

A water purifying apparatus for making it possible to enjoy taking a bath at pleasure on a 24-hour basis has proposed in various patent applications by the present applicant, such as Japanese Utility Model Laid-Open Publication No. Hei 6-48893, and Japanese Patent Laid-Open Publication No. Hei 7-185574. Such a purifying apparatus of bathwater comprises: a filtering device for removing a solid matter, such as hair of a person taking a bath; a water pump for compulsorily circulating the bathwater; an activating device containing an active stone, such as ceramics, shell fossil and Bakahan-stone; an ozone gas generator, or ozonizer, for generating ozone gas for sterilization, deodorization and the like; a heater for heating up the bathwater to a predetermined temperature; and a control device for controlling the ozone gas, the heater and the like. Thus, when the bathwater is passed through the activating device, an organic matter, such as ammonia which leads to purification of the bathwater, is decomposed by bacteria which propagates itself in the active stone and has heteronomy, so that the bathwater may be purified. In addition, ion exchange is taken place in the bathwater, and active ingredients, such as magnesium, zinc, calcium and sodium, are dissolved into the bathwater, so that hydrogen-ion concentration of the bathwater may be controlled in an alkalescent state. As described above, this apparatus has various advantages, but is not economical with regard to heating, because the bathwater is required to be maintained at a predetermined temperature on a 24-hour basis and the heater is formed of an electrical resistive element or the like.

SUMMARY OF THE INVENTION

The present invention has been devised in view of the foregoing conventional circumstances. It is an object of the present invention to provide a heating apparatus having a refrigeration cycle, which is capable of heating efficiently and sanitarily a relatively high temperature hot water supply, bathwater and the like or any combination thereof, without a particular increase in size of the refrigeration cycle, and without any interflow between the bathwater and the water of a hot-water storage tank.

In addition to the aforementioned object, it is another object of the present invention to provide a heating apparatus having a refrigeration cycle, which is capable of heating or drying a bathroom so as to achieve a secure bathroom even for seniors.

It is a further object of the present invention to provide a heating apparatus having a refrigeration cycle, which is capable of enjoying bath healthfully at pleasure on a 24-hour basis.

It is still a further object of the present invention to provide a heating apparatus having a refrigeration cycle, in which the condensing pressure is low and the tapping water temperature is high.

It is yet a further object of the present invention to provide a heating apparatus having a refrigeration cycle, which is capable of supplying high temperature tapping water as well as circulating and heating relatively high temperature water in a hot-water storage tank.

It is still another object of the present invention to provide a heating apparatus having a refrigeration cycle, which is capable of circulating and heating the water in a hot-water storage tank as well as utilizing the water in the hot-water storage tank for increasing the temperature of bathwater, a heat source for floor heating and a heat source for drying.

In order to achieve the aforementioned objects, in a first aspect of the present invention, there is provided a cooling/heating/hot-water supply apparatus, having a refrigeration cycle which includes a compressor, a condenser, an evaporator, the heating apparatus comprising: a first heat exchanger and a second heat exchanger, wherein the first heat exchanger is selected as a heat source, the second heat exchanger being selected as either a cooling or heating source, the first heat exchanger and second heat exchanger being connected in series with each other in a refrigerant circuit; a heat transfer device in which a heating medium is circulated and which is connected to the first heat exchanger; wherein bathwater of a bathtub and water of a hot-water storage tank are heated through the heat transfer device indirectly by the first heat exchanger.

In a second aspect including the first aspect of the present invention, the heating apparatus may further include a bathroom heating device connected to the heat transfer device which is connected to the first heat exchanger, and a cooling/heating device and a floor heating device which are connected to the second heat exchanger.

According to the first and second aspects of the present invention, there is provided the benefits of heating efficiently and sanitarily a relatively high temperature water supply, bathwater and the like and any combinations thereof, without any interflow between the bathwater and the water of the hot-water storage tank.

In a third aspect including the first or second aspect of the present invention, the heating apparatus may further include a bathtub device which is interposed between the heat transfer device and which has a filtering/purifying device for the bathwater.

In a fourth aspect of the present invention, there is provided a cooling/heating/hot-water supply apparatus, having a refrigeration cycle which includes a compressor, a condenser and an evaporator, the heating apparatus comprising: a first heat exchanger, a second heat exchanger, and a third heat exchanger, wherein the first and second heat exchangers are respectively selected as a heat source, the third heat exchanger being selected as either a cooling or heating source, the first and second heat exchangers being connected in series with the third heat exchanger in a refrigerant circuit; a heat transfer device in which a heating medium is circulated and which is connected respectively to the first heat exchanger and the second heat exchanger; wherein bathwater of a bathtub and water of a hot-water storage tank are independently heated through the heat transfer device indirectly by the first heat exchanger and the second heat exchanger respectively.

According to the third and fourth aspects of the present invention, in addition to the aforementioned benefits, there is provided the benefit of maintaining a bathroom at a predetermined temperature, and of achieving a secure bathroom even for seniors. There is also provided the benefits of heating and filtering/purifying the bathwater to enjoy a bath healthfully at ones pleasure on a 24-hour basis.

In a fifth aspect including the fourth aspect of the present invention, the heating apparatus may further include a bathroom heating device connected to the heat transfer device which is connected to the second heat exchanger, and a cooling/heating device and a floor heating device which are connected to the third heat exchanger.

According to the fifth aspect of the present invention, there is provided the benefits of heating the bathroom and cooling/heating a floor.

In order to achieve the aforementioned object, in a sixth aspect of the present invention, there is provided a hot-water supply apparatus, or a heating apparatus, having a refrigeration cycle which includes a compressor, a condenser and an evaporator, wherein the condenser is selected as a hot-water supply heat exchanger to which a feed water pipe and a tapping water pipe are connected, the heating apparatus comprising a flow regulating valve interposed in either one of the feed water pipe and the tapping water pipe, wherein the heating apparatus is adapted to obtain the tapping water of 60° C. or more with a condensing pressure of an allowable pressure or less by determining a parameter of the refrigeration cycle including the feed water flow rate depending on the flow regulating valve, a heating area and size of the hot-water supply heat exchanger and a supercooling rate.

In a seventh aspect of the present invention, there is provided a hot-water supply apparatus, or a heating apparatus, having a refrigeration cycle which includes a compressor, a condenser and an evaporator, wherein the condenser is selected as a hot-water supply heat exchanger to which a feed water pipe and a tapping water pipe are connected, the heating apparatus comprising a flow regulating valve interposed in either one of the feed water pipe and the tapping water supply pipe, wherein the heating apparatus is adapted to allow the feed water of 35° C. or more to be supplied to the hot-water supply heat exchanger with a condensing pressure of an allowable pressure or less, and to obtain the tapping water of 60° C. or more, by determining a parameter of the refrigeration cycle including the feed water flow rate depending on the flow regulating valve, a heating area and size of the hot-water supply heat exchanger and a supercooling temperature.

In a eighth aspect of the present invention, there is provided a hot-water supply apparatus, or a heating apparatus, having a refrigeration cycle which includes a compressor, a condenser and an evaporator, wherein the condenser is selected as a hot-water supply heat exchanger to which a hot-water storage tank is connected through a feed water pipe and a tapping water pipe, hot water in the hot-water storage tank being circulated between the hot-water storage tank and the hot-water supply heat exchanger so as to be heated when a water temperature detected in the hot-water storage tank drops to a predetermined temperature or less, the heating apparatus comprising a flow regulating valve interposed in either one of the feed water pipe and the tapping water pipe, wherein the heating apparatus is adapted to allow the hot water in the hot-water storage tank to be circulated between the hot-water storage tank and the hot-water supply heat exchanger when the water temperature detected in the hot-water storage tank drops to the predetermined temperature or less, and to obtain and store a hot water of 60° C. or more with a condensing pressure of an allowable pressure or less by determining a parameter of the refrigeration cycle including the feed water flow rate depending on the flow regulating valve, a heating area and size of the hot-water supply heat exchanger and a supercooling temperature.

According to the sixth, seventh, and eighth aspects of the present invention, there is provided a particular effect of obtaining a high temperature water of 60° C. or more with the condensing pressure of the allowable pressure or less, and also of allowing hot-water of 35° C. or more to be supplied to the hot-water supply heat exchanger. In addition, since hot water of 35° C. or more can be supplied to the hot-water supply heat exchanger, a high temperature water of 55° C. or more can be stored in the hot-water storage tank by circulating and heating the high temperature water in the storage tank. Thus, circulating and heating the high temperature water allows the hot water in the hot-water storage tank to be utilized as heat sources for heating of bathwater, air/floor heating, drying and the like.

In a ninth aspect including the eighth aspect of the present invention, the heating apparatus may further include a heat load device which serves uses including bathwater, heating, and drying.

In the tenth aspect including one of the sixth to ninth aspects of the present invention, the flow regulating valve may be a pressure type temperature regulating valve for controlling the feed water flow rate by sensing a pressure of the refrigerant in the refrigeration cycle.

DESCRIPTION OF THE PREFERRED EMBODIMENT

Figure 1:
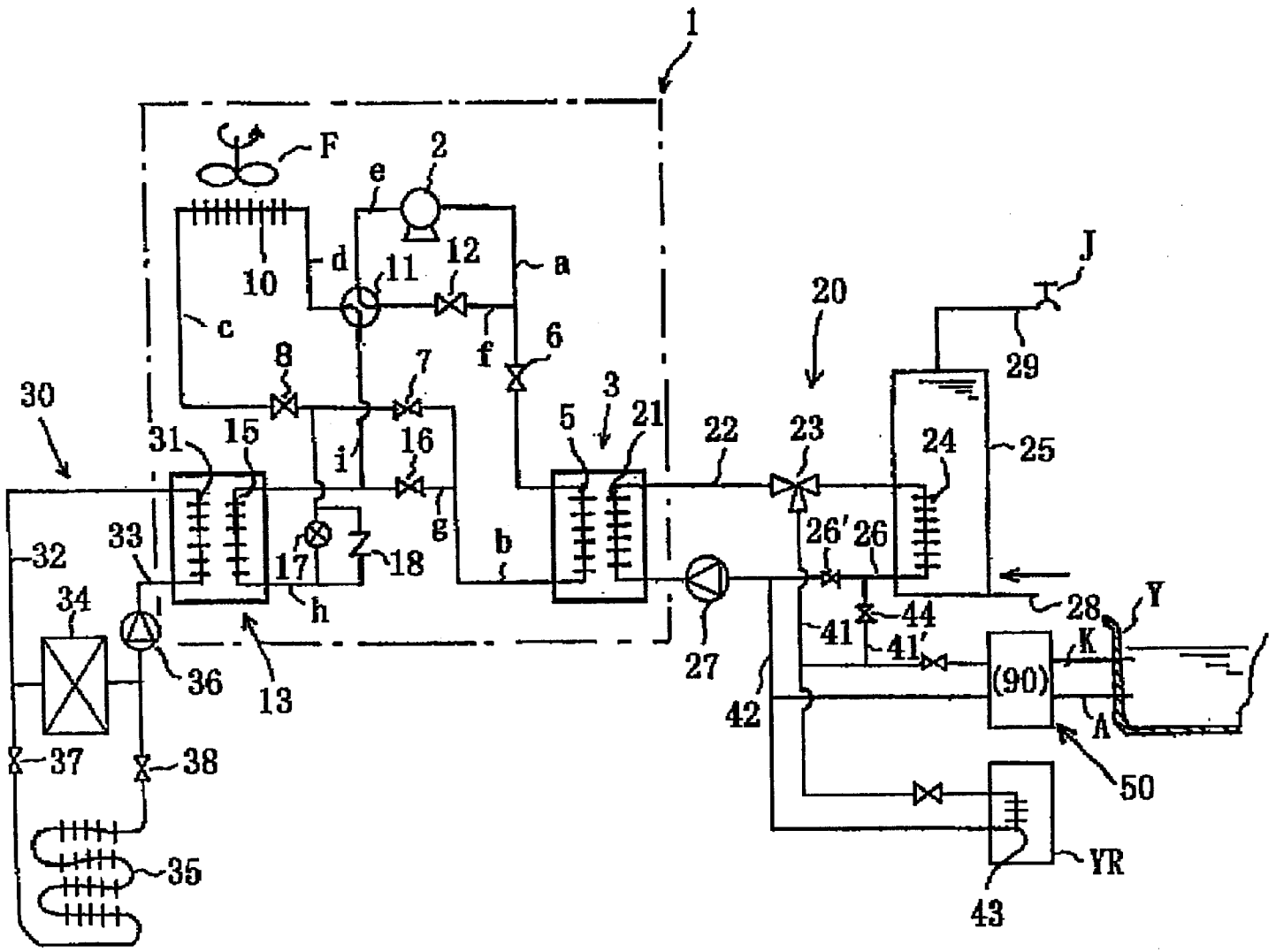
FIG. 1 is a circuit diagram showing a heating apparatus according to the first embodiment of the present invention.

Embodiments of the present invention will be described hereinafter. FIG. 1 is a schematic diagram showing a first embodiment of the present invention. As shown in FIG. 1, a cooling/heating/hot-water supply apparatus, according to the first embodiment is configured as a unit 1 which includes a compressor 2, a first heat exchanger 3, a second heat exchanger 13, and a heat source heat exchanger 10 that acts as either an evaporator or a condenser. A feed water/bathwater heating device 20 and a cooling/heating device 30 are provided in association with the unit 1.

In the present embodiment, the first heat exchanger 3 is selected as a heat source for heating a heating medium for use in feed water, bathwater and bathroom heating and thereby acts as a condenser, while the second heat exchanger 13 is selected as either a heating or cooling source, and thereby acts selectively as a condenser or an evaporator, respectively, by adequately switching refrigerant ducts.

The first heat exchanger 3 comprises a first heat exchange portion 5 through which a refrigerant, such as ammonia as an alternative to CFC, is passed, and a second heat exchange portion 21 through which the heating medium, such as water, is passed. While fins of the first and second heat exchange portions 5, 21 are separately shown in FIG. 1, they are practically integrated and contained within a heat insulating housing. The first heat exchange portion 5 of the first heat exchanger 3 is connected to a discharge port of the compressor 2 through a refrigerant liquid duct "a". An outlet port of the first heat exchange portion 5 is connected to an inlet port of the heat source heat exchanger 10 through refrigerant ducts "b" and "c" respectively, and an outlet port of the heat source heat exchanger 10 is connected to a suction port of the compressor 2 through refrigerant gas duct "d" and "e". A first solenoid control valve 6 is interposed in the refrigerant liquid duct "a", and a second and third solenoid control valves 7, 8 are interposed in the refrigerant gas ducts "b" and "c", respectively. A four-way switching valve 11 is provided between the refrigerant ducts "d" and "e", and a fourth solenoid control valve 12 is interposed in a duct "f" connecting one port of the four-way switching valve 11 and the refrigerant liquid duct "a". Thus, a heat cycle for acting as a heat source is composed of the compressor 2, the first heat exchanger 3, the heat source heat exchanger 10 and the like. A cooling fan F is additionally provided in association with the heat source heat exchanger 10.

The second heat exchanger 13 includes a first heat exchange portion 15 through which the refrigerant is passed and a second heat exchange portion 31 through which a heating medium, such as water, is passed. Fins of the first and second heat exchange portions 15, 31 are also integrated and contained within a heat insulating housing. A refrigerant duct "g" branched from the refrigerant duct "b" and a refrigerant duct "h" are connected to inlet port and outlet ports of the first heat exchange portion 15, respectively. The refrigerant duct "h" is connected to the refrigerant duct "c" between the second and third solenoid control valves 7, 8. A fourth solenoid control valve 16 is interposed in the refrigerant duct "g". A refrigerant duct "I" is branched from the refrigerant duct "g" at the downstream of the fourth solenoid control valve 16 and is connected to one port of the four-way switching valve 11. In the refrigerant duct "h", an expansion valve 17 and a check valve 18 are provided in parallel. Thus, a heat cycle or refrigeration cycle is composed of the compressor 2, the second heat exchanger 13, the heat source heat exchanger 10 and the like.

In the present embodiment, the feed water/bathwater heating device 20 includes the heat exchange portion 21, a heat exchanger 24 located within a hot-water storage tank 25, inflow and outflow ducts 22, 26, and the like. The inflow and outflow ducts 22, 26 are filled with a heating medium, such as water. A three-way switching valve 23 is interposed in the inflow duct 22, and a solenoid control valve 26' and a pump 27 are interposed in the outflow duct 26. Thus, when the pump 27 is activated, the heating medium is circulated between the heat exchange portion 21 and the heat exchanger 24 so that the water in the hot-water storage tank 25 may be heated. The hot-water storage tank 25 is a push-up type and a feed water pipe 28 is connected to a pressurized source, such as a city water pipe. Thus, hot water can be served by turning on a tap J of a tapping water pipe 29 located at an upper side of the hot-water storage tank 25.

In order to heat bathwater in a bathtub Y and to provide drying or heating of a bathroom YR, a heating duct 41 is extended from one port of the three-way valve 23 in the inflow duct 22, and a return duct 42 is branched from the outflow duct 26. The outflow duct 26 and heating duct 41 are connected in parallel with each other by a connecting duct 41' in which a solenoid control valve 44 is interposed. The heating duct 41 and return duct 42 are connected to a bathtub device 50, and the bathtub device 50 and the bathtub Y are connected through circulation ducts A, K. The heating duct 41 and return duct 42 are also connected to a radiator 43 of the bathroom YR in parallel with each other. The bathtub device 50 interposed in the heating duct 41 and return duct 42 will be described later.

As shown in FIG. 1, the cooling/heating device 30 for cooling and heating a plurality of indoors and floors by the second heat exchanger 13 includes ducts 32, 33. An outlet port and inlet port of the second heat exchanger 31 are connected to the duct 32 and duct 33, respectively. A plurality of cooling/heating heat exchangers 34, 34, . . . , 34 are provided in parallel with the ducts 32, 33, and a floor heating heat exchanger 35 is provided in series with the ducts 32, 33. Solenoid control valves 37, 38 are interposed in the ducts 32, 33, respectively.

By virtue of the construction as described above, the cooling/heating/hot-water supply apparatus according to the first embodiment can provide various patterns of heating or cooling. A typical method for cooling/heating and hot water supply will be described hereinafter. This cooling/heating/hot-water supply apparatus having a refrigeration cycle is also provided with a control device, and thereby can be automatically operated by setting up a control temperature, time and the like. However, in order to make the description clear, the following example will be described as an apparatus which is manually operated. While the first to fourth solenoid control valves 6, 7, 8 and 16 are properly controlled, the open/close states of these valves will not be described in each case. The bathtub device 50 is adapted to be automatically operated to allow users to take a bath on a 24-hours basis by a control device having a timer, preferably a weekly timer, a temperature sensor and the like.

In the following description, heating of bathwater in the bathtub Y is referred to as "bathtub heating", and heating of water in the hot-water storage tank 25 is referred to as "feed water heating".

A. Bathtub Heating

When it is detected that a bathwater temperature drops to a predetermined temperature or less, for example, by a temperature sensor provided in the bathtub device 50, the refrigeration cycle is activated. Then, the refrigerant is circulated through the compressor 2, the first solenoid control valve 6, the first heat exchanger 3, the second and third solenoid control valves 7, 8, the heat source heat exchanger 10, the four-way switching valve 11, and the compressor 2, in this order. Thus, the first heat exchanger 3 as a condenser is heated and the second heat exchange portion 21 is thereby heated. The pump 27 of the feed water/bathwater heating device 20 is activated and the heating medium, such as water, is circulated through the second heat exchange portion 21, the three-way switching valve 23, a heat exchanger 90 of the bathtub device 50 and the second heat exchange portion 21, in this order. Thus, the bathwater in the bathtub Y is heated. The details will be described later in conjunction with components of the bathtub device 50.

B. Feed water Heating

The refrigerant is circulated through the compressor 2, the first solenoid control valve 6, the first heat exchanger 3, the second and third solenoid control valves 7, 8, the heat source heat exchanger 10, the four-way switching valve 11, and the compressor 2, in this order. Thus, the first heat exchanger 3 as a condenser is heated and the second heat exchange portion 21 is thereby heated. The pump 27 is activated and the heating medium of water is circulated through the second heat exchange portion 21 of the first heat exchanger 3, the three-way switching valve 23, the heat exchanger 24 of the hot-water storage tank 25, the solenoid control valve 26', the pump 27, and the second heat exchange portion 21, in this order. Thus, the water in the hot-water storage tank 25 is heated and stored. Hot water can be served by turning on a tap J, as is widely known.

C. Bathtub/Feed water Heating

The refrigerant is circulated as the aforementioned A and B and the first heat exchanger 3 is thereby heated. The pump 27 is activated, and the heating medium is circulated through the second heat exchange portion 21 of the first heat exchanger 3, the three-way switching valve 23, the heat exchanger 24 of the hot-water storage tank 25, the solenoid control valve 44, the heat exchanger 90 of the bathtub device 50, the pump 27 and the second heat exchange portion 21, in this order. Thus, the water in the hot-water storage tank 25 and the bathwater in the bathtub Y are heated respectively.

D. Bathtub Heating plus Space/Floor Heating

The refrigerant is circulated through the compressor 2, the first solenoid control valve 6, the first heat exchange portion 5 of the first heat exchanger 3, the fourth solenoid control valve 16, the first heat exchange portion 15 of the second heat exchanger 13, the check valve 18, the third control valve 8, the heat source heat exchanger 10, the four-way switching valve 11, and the compressor 2, in this order. Thus, the first heat exchanger 3 as a condenser is heated and the second heat exchange portion 21 is thereby heated. The pump 27 of the feed water/bathwater heating device 20 is activated, and the heating medium, such as water, is circulated through the second heat exchange portion 21, the tree-way switching valve 23, the heat exchanger 90 of the bathtub device 50, and the second heat exchange portion 21, in this order. Thus, the bathtub heating can be performed. The second heat exchanger 13 acts as a condenser and is thereby heated. A pump 36 of the cooling/heating device 30 is activated, and the heating medium, such as water, is circulated through the second heat exchange portion 31, the cooling/heating heat exchanger 34 and the floor heating heat exchanger 35, the pump 36, and the second heat exchange portion 31, in this order. By this circulation of the heated water, the cooling/heating heat exchanger 34 can provide a space heating, such as indoor heating, and the floor heating heat exchanger 35 can provide a floor heating. In parallel with these operations, the feed water heating can be performed as described in the aforementioned C. Thus, according to the present embodiment, the bathtub and feed water heating plus the space and floor heating can be achieved.

E. Bathtub Heating plus Space/Floor Cooling

The refrigerant is circulated through the compressor 2, the first solenoid control valve 6, the first heat exchange portion 5 of the first heat exchanger 3, the second solenoid control valve 7, the expansion valve 17, the first heat exchange portion 15 of the second heat exchanger 13, the four-way switching valve 11, and the compressor 2, in this order. The pump 27 of the feed water/bathwater heating device 20 is activated, and the heating medium, such as water, is circulated through the second heat exchange portion 21, the three-way switching valve 23, the heat exchanger 90 of the bathtub device 50, and the second heat exchange portion 21, in this order. Thus, the bathtub heating can be performed. The second heat exchanger 13 acts as an evaporator and is thereby cooled. The pump 36 of the cooling/heating device 30 is activated, and the heating medium, such as water, is circulated through the second heat exchange portion 21, the cooling/heating heat exchanger 34, the pump 36, and the second heat exchange portion 31, in this order. By this circulation of the cooled water, the cooling/heating heat exchanger 34 can provide a space cooling, such as indoor cooling. During this time, circulating the cooled water through the floor heating heat exchanger 35 can provide a floor cooling. The feed water heating can be performed in parallel with the aforementioned operations as described above. Thus, the bathtub and feed water heating plus the space and floor cooling can be achieved.

F. Feed water Heating plus Space/Floor Heating

The refrigerant is circulated through the compressor 2, the first solenoid control valve 6, the first heat exchange portion 5 of the first heat exchanger 3, the fourth solenoid control valve 16, the first heat exchange portion 15 of the second heat exchanger 13, the check valve 18, the third control valve 8, the heat source heat exchanger 10, the four-way switching valve 11, and the compressor 2, in this order. Thus, the first heat exchanger 3 as a condenser is heated and the second heat exchange portion 21 is thereby heated. The pump 27 of the feed water/bathwater heating device 20 is activated, and the heating medium, such as water, is circulated through the second heat exchange portion 21, the three-way switching valve 23, the heat exchanger 24 of the hot-water storage tank 25, the pump 27, and the second heat exchange portion 21, in this order. Thus, the water in the hot-water storage tank 25 is heated. The second heat exchanger 13 also acts as a condenser and is thereby heated. The pump 36 of the cooling/heating device 30 is activated, and the heating medium, such as water, is circulated through the second heat exchanger 31, the cooling/heating heat exchanger 34 and the floor heating heat exchanger 35, the pump 36, and the second heat exchange portion 31, in this order. By this circulation of the heated water, the cooling/heating heat exchanger 34 can provide a space heating, such as indoor heating, and the floor heating heat exchanger 35 can provide a floor heating.

G. Feed water Heating plus Space/Floor Cooling

The refrigerant is circulated through the compressor 2, the first solenoid control valve 6, the first heat exchange portion 5 of the first heat exchanger 3, the second solenoid control valve 7, the expansion valve 17, the first heat exchange portion 15 of the second heat exchanger 13, the four-way switching valve 11, and the compressor 2, in this order. Thus, the first heat exchanger 3 as a condenser is heated and the second heat exchange portion 21 is thereby heated. The pump 27 is activated and the heating medium of water is circulated through the second heat exchange portion 21, the three-way switching valve 23, the heat exchanger 24 of the hot-water storage tank 25, the pump 27, and the second heat exchange portion 21, in this order. Thus, the water in the hot-water storage tank 25 is heated and stored. Hot water can be served by turning on a tap J, as is widely known. The pump 36 of the cooling/heating device 30 is activated, and the heating medium, such as water, is circulated through the second heat exchange portion 31, the cooling/heating heat exchanger 34, the pump 36, and the second heat exchange portion 31, in this order. By this circulation of the cooled water, the cooling/heating heat exchanger 34 can provide a space cooling, such as indoor cooling.

H. Drying or Heating of Bathroom

The refrigerant is circulated through the compressor 2, the first solenoid control valve 6, the first heat exchanger 3, the second and third solenoid control valves 7, 8, the heat source heat exchanger 10, the four-way switching valve 11, and the compressor 2, in this order. Thus, the first heat exchanger 3 as a condenser is heated and the second heat exchange portion 21 is thereby heated. The pump 27 of the feed water/bathwater heating device 20 is activated, and the heating medium, such as water, is circulated through the second heat exchange portion 21, the tree-way switching valve 23, the radiator 43 of the bathroom YR, the pump 27, and the second heat exchange portion 21, in this order. Thus, a space heating and drying of the bathroom can be performed.

I. Space/Floor Heating

The refrigerant is circulated through the compressor 2, the fourth solenoid control valve 12, the four-way switching valve 11, the first heat exchange portion 15 of the second heat exchanger 13, the check valve 18, the third solenoid control valve 8, the heat source heat exchanger 10, the four-way switching valve 11, and the compressor 2, in this order. Thus, the heat source exchanger 10 acts as an evaporator, while the second heat exchanger 13 acts as a condenser and is thereby heated. The pump 36 of the cooling/heating device 30 is activated, and the heating medium, such as water, is circulated through the second heat exchange portion 31, the cooling/heating heat exchanger 34 and the floor heating heat exchanger 35, the pump 36, and the second heat exchange portion 31, in this order. By this circulation of the heated water, the cooling/heating heat exchanger 34 can provide a space heating, such as indoor heating, and the floor heating heat exchanger 35 can provide a floor heating.

J. Space/Floor Cooling

The refrigerant is circulated through the compressor 2, the fourth solenoid control valve 12, the four-way switching valve 11, the heat source heat exchanger 10, the third solenoid control valve 8, the expansion valve 17, the first heat exchange portion 15 of the second heat exchanger 13, the four-way switching valve 11, and the compressor 2, in this order. Thus, the heat source exchanger 10 acts as a condenser, while the second heat exchanger 13 acts as an evaporator and is thereby cooled. The pump 36 of the cooling/heating device 30 is activated, and the heating medium, such as water, is circulated through the second heat exchange portion 21, the cooling/heating heat exchanger 34, the pump 36, and the second heat exchange portion 31, in this order. By this circulation of the cooled water, the cooling/heating heat exchanger 34 can provide a space cooling, such as indoor cooling. During this time, circulating the cooled water through the floor heating heat exchanger 35 can provide a floor cooling, as described above.

Figure 2:
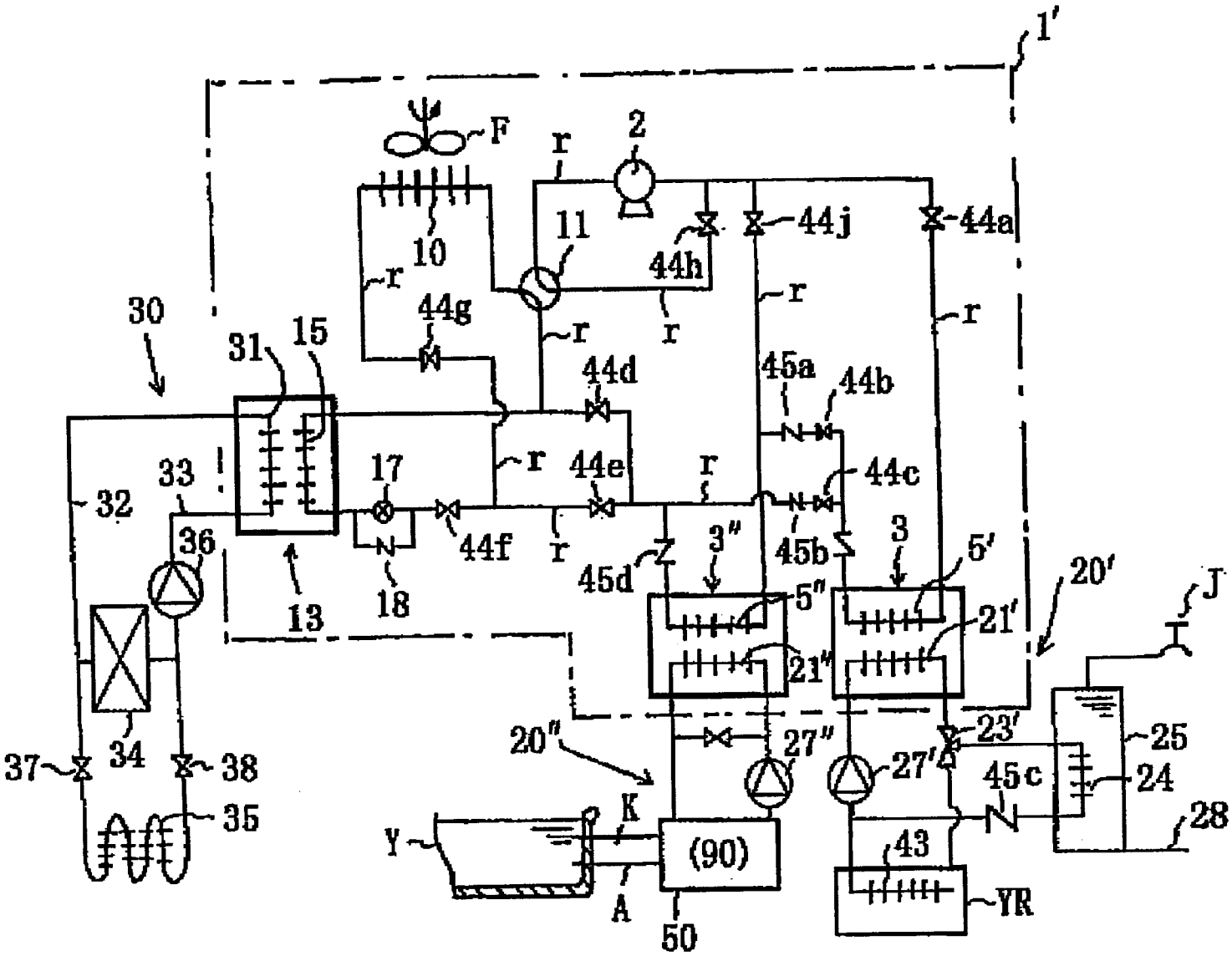
FIG. 2 is a circuit diagram showing a heating apparatus according to the second embodiment of the present invention.

With reference to FIG. 2, a second embodiment of the present invention will be described. In the drawing, the same elements of structure as those of the first embodiment shown in FIG. 1 are identified by the same reference numerals, the similar elements being identified by adding dash ' or double dash " to the same reference numerals, and their description will be omitted. In FIG. 2, the symbol "r" indicates a refrigerant duct, the reference numbers 44*a*, 44*b*, 44*c*, —, 44*j* indicating solenoid control valves, the reference numbers 45*a*, 45*b*, 45*c*, 45*d* indicating check valves. In the second embodiment, while a feed-water heat exchanger 3' and bathtub heat exchanger 3" are separated from each other so that the feed water and bathwater will not be mixed even if some duct or the like is broken, the bathtub heating and heating/cooling function in the same manner in the first embodiment. This example will be described hereinafter. The second embodiment is also described on condition that the solenoid control valves 44*a*, 44*b*, 44*c*, —, 44*j* are properly opened and closed.

A'. Bathtub Heating

When it is detected that a bathwater temperature drops to a predetermined temperature or less, for example, by a temperature sensor provided in the bathtub device 50, the refrigeration cycle is activated. Then, the refrigerant is circulated through the compressor 2, the solenoid control valve 44*j*, the bathtub heat exchanger 3", the check valve 45*d*, the solenoid control valves 44*e*, 44*g*, the heat source heat exchanger 10, the four-way switching valve 11, and the compressor 2, in this order. Thus, the bathtub heat exchanger 3" as a condenser is heated and its second heat exchange portion 21" is thereby heated. A pump 27" of a bathwater heating device 20" is activated and the heating medium, such as water, is circulated through the second heat exchange portion 21", the heat exchanger 90 of the bathtub device 50, the second heat exchange portion 21", and the pump 27", in this order. Thus, the bathwater in the bathtub Y is heated as described above.

B'. Feed water Heating

The refrigerant is circulated through the compressor 2, the solenoid control valve 44*a*, a first heat exchange portion 5' of a feed-water heat exchanger 3', the solenoid control valve 44*c*, the check valve 45*b*, the solenoid control valves 44*e*, 44*g*, the heat source heat exchanger 10, the four-way switching valve 11, and the compressor 2, in this order. Thus, the feed-water heat exchanger 3' as a condenser is heated and the second heat exchange portion 21' is thereby heated. A pump 27' is activated and the heating medium of water is circulated through the second heat exchange portion 21' of the feed-water heat exchanger 3', the three-way switching valve 23', the heat exchanger 24 of the hot-water storage tank 25, the check valve 45*c*, the pump 27', and the second heat exchange portion 21', in this order. Thus, the water in the hot-water storage tank 25 is heated and stored. Hot water can be served by turning on a tap J, as is widely known.

C'. Bathtub/Feed water Heating

The refrigerant is circulated through the compressor 2, the solenoid control valve 44*a*, the first heat exchange portion 5' of the feed-water heat exchanger 3', the solenoid control valve 44*b*, the check valve 45*a*, a first heat exchange portion 5" of the bathtub heat exchanger 3", the check valve 45*d*, the solenoid control valves 44*e*, 44*g*, the heat source heat exchanger 10, the four-way switching valve 11, and the compressor 2, in this order. Thus, the feed-water heat exchanger 3' and bathtub heat exchanger 3" as condensers are heated. The pump 27" of the bathwater heating device 20" is activated, and the heating medium is circulated through the second heat exchange portion 21", the heat exchanger 90 of the bathtub device 50, the second heat exchange portion 21", and the pump 27", in this order. Thus, the water in the bathtub Y is heated. Simultaneously, the pump 27' of the feed-water heating device 20' is activated, and the heating medium is circulated through the second heat exchange portion 21' of the feed-water heat exchanger 3', the three-way switching valve 23', the heat exchanger 24 of the hot-water storage tank 25, the check valve 45*c*, the pump 27', and the second heat exchange portion 21', in this order. Thus, the water in the hot-water storage tank 25 is heated and stored.

D'. Bathtub Heating plus Space/Floor Heating

The refrigerant is circulated through the compressor 2, the solenoid control valve 44*j*, the first heat exchange portion 5" of the bathtub heat exchanger 3", the check valve 45*d*, the solenoid control valve 44*d*, the first heat exchange portion 15 of the second heat exchanger 13, the check valve 18, the solenoid control valves 44*f* and 44*g*, the heat source heat exchanger 10, the four-way switching valve 11, and the compressor 2, in this order. Thus, the bathtub heat exchanger 3" as a condenser is heated and the second heat exchange portion 21" is thereby heated. The pump 27" of the bathwater heating device 20" is activated, and the heating medium, such as water, is circulated through the second heat exchange portion 21", the heat exchanger 90 of the bathtub device 50, and the second heat exchange portion 21", in this order. Thus, the bathtub heating can be performed. The second heat exchanger 13 acts as a condenser and is thereby heated. The pump 36 of the cooling/heating device 30 is activated, and the heating medium, such as water, is circulated through the second heat exchange portion 31, the cooling/heating heat exchanger 34 and the floor heating heat exchanger 35, the pump 36, and the second heat exchange portion 31, in this order. By this circulation of the heated water, the cooling/heating heat exchanger 34 can provide a space heating, such as indoor heating, and the floor heating heat exchanger 35 can provide a floor heating.

E'. Bathtub Heating plus Space/Floor Cooling

The refrigerant is circulated through the compressor 2, the solenoid control valve 44*j*, the first heat exchange portion 5" of the bathtub heat exchanger 3", the check valve 45*d*, the solenoid control valves 44*e* and 44*f*, the expansion valve 17, the first heat exchange portion 15 of the second heat exchanger 13, the four-way switching valve 11, and the compressor 2, in this order. The pump 27" of the bathwater heating device 20" is activated, and the heating medium, such as water, is circulated through the second heat exchange portion 21", the heat exchanger 90 of the bathtub device 50, and the second heat exchange portion 21", in this order. Thus, the bathtub heating can be performed. The second heat exchanger 13 acts as an evaporator and is thereby cooled. The pump 36 of the cooling/heating device 30 is activated, and the heating medium which is cooled is circulated through the second heat exchange portion 21, the cooling/heating heat exchanger 34, the pump 36, and the second heat exchange portion 31, in this order. By this circulation of the cooled water, the cooling/heating heat exchanger 34 can provide a space cooling, such as indoor cooling. During this time, circulating the cooled water through the floor heating heat exchanger 35 can provide a floor cooling.

F'. Feed water Heating plus Space/Floor Heating

The refrigerant is circulated through the compressor 2, the solenoid control valve 44*a*, the first heat exchange portion 5' of the feed-water heat exchanger 3', the solenoid control valve 44*c*, the check valve 45*b*, solenoid control valve 44*d*, the first heat exchange portion 15 of the second heat exchanger 13, the check valve 18, the solenoid control valves 44*f* and 44*g*, the heat source heat exchanger 10, the four-way switching valve 11, and the compressor 2, in this order. Thus, the feed-water heat exchanger 3' as a condenser is heated and the second heat exchange portion 21' is thereby heated. The pump 27' of the feed-water heating device 20' is activated, and the heating medium is circulated through the second heat exchange portion 21', the three-way switching valve 23', the heat exchanger 24 of the hot-water storage tank 25, the pump 27', and the second heat exchange portion 21', in this order. Thus, the water in the hot-water storage tank 25 is heated. The second heat exchanger 13 also acts as a condenser and is thereby heated. The pump 36 of the cooling/heating device 30 is activated, and the heating medium, such as water, is circulated through the second heat exchanger 31, the cooling/heating heat exchanger 34 and the floor heating heat exchanger 35, the pump 36, and the second heat exchange portion 31, in this order. By this circulation of the heated water, the cooling/heating heat exchanger 34 can provide a space heating, such as indoor heating, and the floor heating heat exchanger 35 can provide a floor heating.

G'. Feed water Heating plus Space/Floor Cooling

The refrigerant is circulated through the compressor 2, the solenoid control valve 44*a*, the first heat exchange portion 5' of the feed-water heat exchanger 3', the solenoid control valve 44*c*, the check valve 45*b*, the solenoid control valves 44*e* and 44*f*, the expansion valve 17, the first heat exchange portion 15 of the second heat exchanger 13, the four-way switching valve 11, and the compressor 2, in this order. Thus, the feed-water heat exchanger 3' as a condenser is heated and the second heat exchange portion 21' is thereby heated. The pump 27' is activated and the heating medium of water is circulated through the second heat exchange portion 21', the three-way switching valve 23', the heat exchanger 24 of the hot-water storage tank 25, the pump 27', and the second heat exchange portion 21', in this order. Thus, the water in the hot-water storage tank 25 is heated and stored. The pump 36 of the cooling/heating device 30 is activated, and the heating medium, such as water, is circulated through the second heat exchange portion 31, the cooling/heating heat exchanger 34, the pump 36, and the second heat exchange portion 31, in this order. By this circulation of the cooled water, the cooling/heating heat exchanger 34 can provide a space cooling, such as indoor cooling.

H'. Drying or Heating of Bathroom

The refrigerant is circulated through the compressor 2, the solenoid control valve 44*a*, the feed-water heat exchanger 3', the solenoid control valve 44*c*, the check valve 45*b*, the solenoid control valves 44*e* and 44*g*, the heat source heat exchanger 10, the four-way switching valve 11, and the compressor 2, in this order. Thus, the feed-water heat exchanger 3' as a condenser is heated and the second heat exchange portion 21' is thereby heated. The pump 27' of the feed-water heating device 20' is activated, and the heating medium is circulated through the second heat exchange portion 21', the tree-way switching valve 23', the radiator 43 of the bathroom YR, the pump 27', and the second heat exchange portion 21', in this order. Thus, a space heating and drying of the bathroom can be performed.

I'. Space/Floor Heating

The refrigerant is circulated through the compressor 2, the solenoid control valve 44*h*, the four-way switching valve 11, the first heat exchange portion 15 of the second heat exchanger 13, the check valve 18, the solenoid control valve 44*f*, the solenoid control valve 44*g*, the heat source heat exchanger 10, the four-way switching valve 11, and the compressor 2, in this order. Thus, the heat source exchanger 10 acts as an evaporator, while the second heat exchanger 13 acts as a condenser and is thereby heated. The pump 36 of the cooling/heating device 30 is activated, and the heating medium is circulated through the second heat exchange portion 31, the cooling/heating heat exchanger 34 and the floor heating heat exchanger 35, the pump 36, and the second heat exchange portion 31, in this order. By this circulation of the heated water, the cooling/heating heat exchanger 34 can provide a space heating, such as indoor heating, and the floor heating heat exchanger 35 can provide a floor heating.

J'. Space/Floor Cooling

The refrigerant is circulated through the compressor 2, the solenoid control valve 44*h*, the four-way switching valve 11, the heat source heat exchanger 10, the solenoid control valve 44*g*, the solenoid control valve 44*f*, the expansion valve 17, the first heat exchange portion 15 of the second heat exchanger 13, the four-way switching valve 11, and the compressor 2, in this order. Thus, the heat source exchanger 10 acts as a condenser, while the second heat exchanger 13 acts as an evaporator and is thereby cooled. The pump 36 of the cooling/heating device 30 is activated, and the space/floor cooling can be provided as described above.

K'. Bathtub/Feed water Heating plus Space/Floor Heating

The refrigerant is circulated through the compressor 2, the solenoid control valve 44*a*, the first heat exchange portion 5' of the feed-water heat exchanger 3', the solenoid control valve 44*b*, the check valve 45*a*, the first heat exchange portion 5" of the bathtub heat exchanger 3", the check valve 45*d*, the solenoid control valve 44*d*, the first heat exchange portion 15 of the second heat exchanger 13, the check valve 18, the solenoid control valves 44*f* and 44*g*, the heat source heat exchanger 10, the four-way switching valve 11, and the compressor 2, in this order. Thus, the feed-water heat exchanger 3' and bathtub heat exchanger 3" as condensers are heated. The second heat exchanger 13 is also heated. As described above, the bathtub and feed water heating can be provided as well as the space and floor heating.

L'. Bathtub/Hot-Water Heating plus Space/Floor Cooling

The refrigerant is circulated through the compressor 2, the solenoid control valve 44*a*, the first heat exchange portion 5' of the feed-water heat exchanger 3', the solenoid control valve 44*b*, the check valve 45*a*, the first heat exchange portion 5" of the bathtub heat exchanger 3", the check valve 45*d*, the solenoid control valves 44*e* and 44*f*, the expansion valve 17, the first heat exchange portion 15 of the second heat exchanger 13, the four-way switching valve 11, and the compressor 2, in this order. The feed-water heat exchanger 3' and bathtub heat exchanger 3" as condensers are heated. The second heat exchanger 13 acts as an evaporator. Thus, in addition to the bathtub and feed water heating, the space and floor cooling can be provided as described above.

Figure 3:
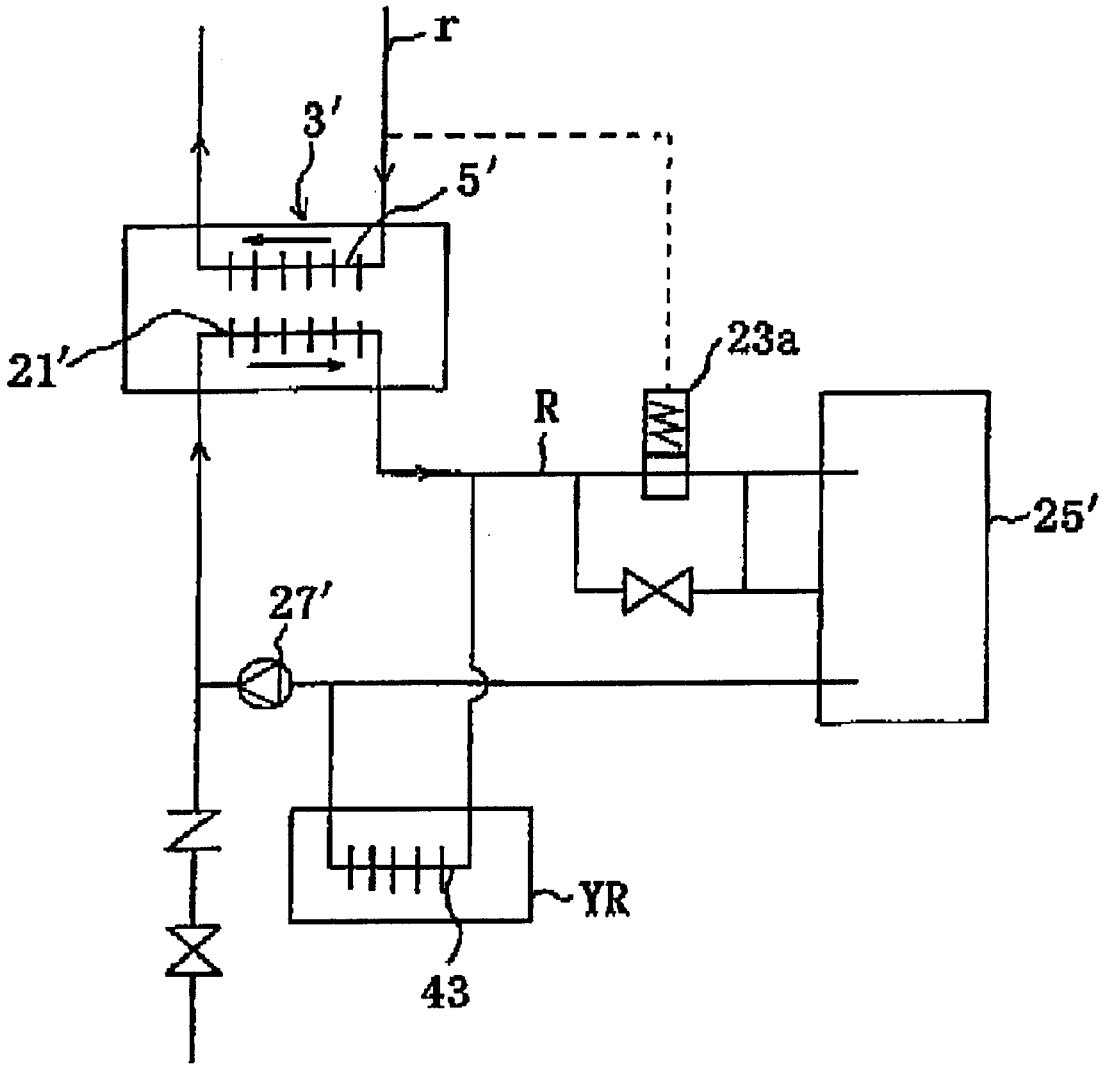
FIG. 3 is a circuit diagram showing a heating apparatus according to the third embodiment of the present invention.

FIG. 3 shows a third embodiment of the present invention. This embodiment is one example in which the feed-water heating device 20' of the second embodiment shown in FIG. 2 is modified to allow the water in the hot-water storage tank 25' to be directly heated. According to the third embodiment, the hot-water storage tank 25' is adapted to make the water thereof flow in the opposite direction with respect to the flow of the refrigerant, within the feed-water heat exchanger 3'. A gate valve 23*a* is interposed in a water circulation duct R, and a particular spring bias and a refrigerant pressure are loaded on the gate valve 23*a*. The feed-water heat exchanger 3' has about a doublewide heating area, or heating surface area, compared with regular heat exchangers. The feed-water heat exchanger 3' also has narrowed heat exchange portions for exchanging heat between refrigerant and water.

According to the third embodiment, the following effects can be obtained.

Whereas the first and second embodiments shown in FIG. 1 and 2, respectively, provide about 50° C. of relatively low tapping water temperature with 21 Kg/cm2 of heating medium pressure and about 54° C. of condensing temperature, the present embodiment can sufficiently condense the refrigerant and can increase supercooling because the heating area is selected to be about twice as large as regular heat exchangers and the heat exchange portions for heat exchanging between refrigerant and water are narrowed, or positioned closely to each other. Thus, according to the present embodiment, about 70° C. of high temperature water can be obtained. In addition, since the gate valve 23*a* is provided in the feed-water heating device, stable performances in each operation mode can be assured. When the feed water heating and the space/floor heating are simultaneously operated, the water is not passed through the feed-water heating device if it is required to operate the space/floor heating with 100% load. If it is required to operate the space/floor heating with 50% load, the feed-water heating device allows gaining 50% of heat quantity from the refrigerant. The feed-water heat exchanger is operated under 50% load with its 100% machine ability and the heating area of the feed-water heat exchanger is twice as wide as regular heat exchangers. That is, the heat exchange would be practically performed with fourfold heating area to the 50% of heat quantity, and the feed water may thereby be given a sufficient high temperature closed to that of the refrigerant at discharge port of the compressor. Since the feed water heating is independently performed by priority as with the bathtub heating, the feed-water heat exchanger may provide sufficient high temperature to the feed-water heating device. Even in changing the operation mode, a continuous operation can also be performed without any usual operations in which the user is required to stop the machine and to wait for more than three minutes, resulting in longer machine's life. In the present embodiment, since the heating is performed with adjusting the condensing pressure of the refrigerant to a constant value, a stable operation can be performed. In addition, the feed water heating can be stably performed under a low condensing pressure even in the coldest season due to the constant condensing pressure. Thus, it is difficult for the heat exchanger to be frosted, and a possible frost can be defrosted in a matter of minutes by applying a reverse cycle. It will be understood to variously modify the first and second embodiments described above. For example, in cooling use, since the heat source heat exchanger 10 acts as a condenser and releases heat, the released heat may be utilized for the heating of the bathroom YR. In space/floor heating or bathtub/feed water heating use, the heat source heat exchanger 10 acts as an evaporator. In the case where a heat medium, such as outside air or water, which is heat exchanged in the heat source heat exchanger 10, has a low temperature, the heat medium may be obtained from the ground so that the refrigeration cycle can be operated by using ground heat even in winter season.

Figure 4:
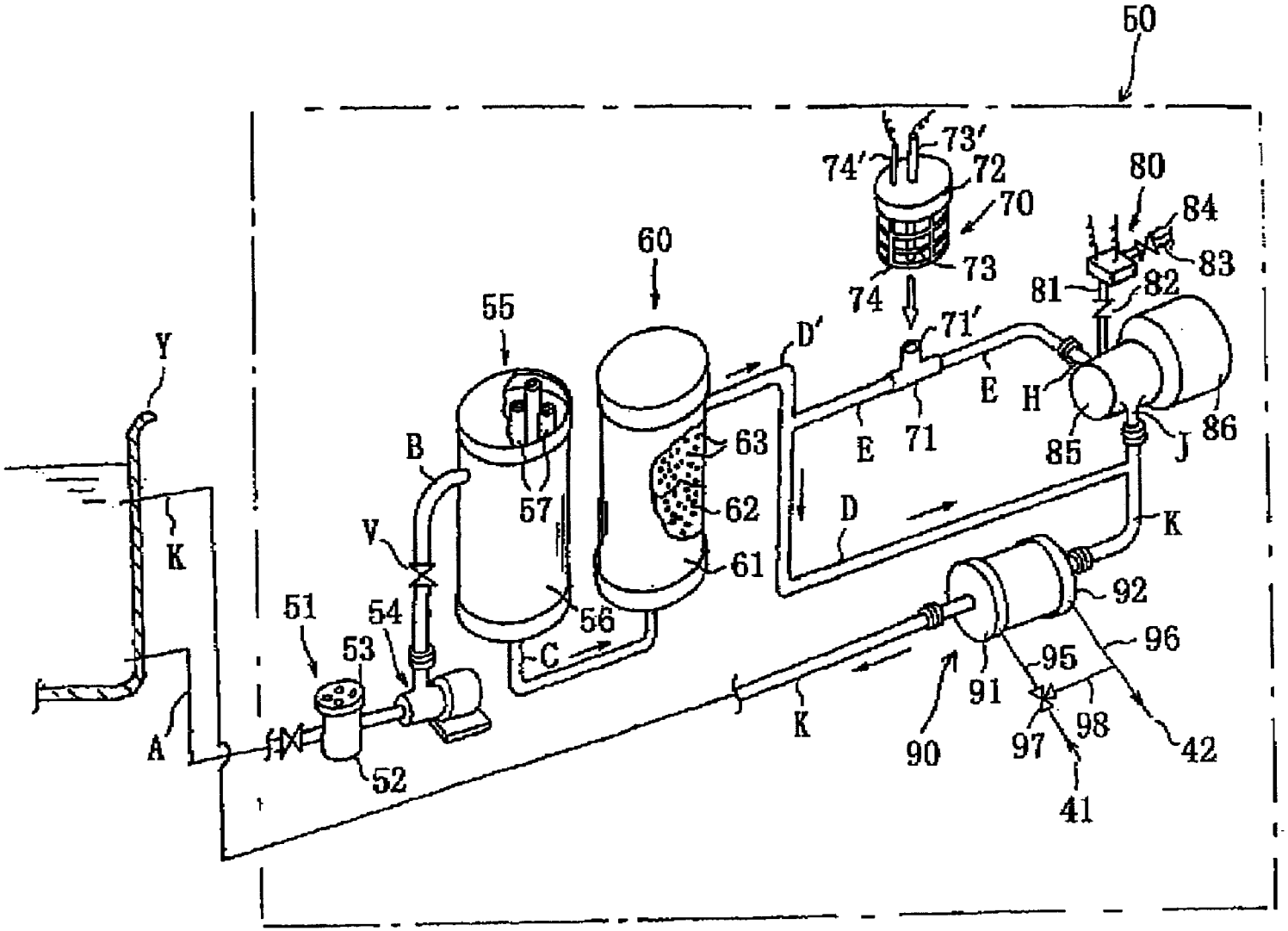
FIG. 4 is a schematic perspective view showing an embodiment of a bathtub device, wherein a part of the device is shown in section.

FIG. 4 shows one embodiment of the bathtub device 50 shown in FIG. 2. The bathtub device 50 according to the present embodiment schematically comprises a hair catcher 51, a circulating pump 54, a filtering device 55, an antibacterial container 60, a silver ion generator 70, an ozone gas generator 80, a cascade pump 85, and a heat exchanger 90. The hair catcher 51 comprises a container 52, a cap 53 detachably attached to the container 52, and a filter contained in the container 52. The hair catcher 51 is interposed in a circulation duct K upstream of the filtering device 55, and the circulation duct K is connected to the bathtub Y. Since the bathtub device 50 according to the present embodiment is intended to be installed in business equipments having relatively large throughput capacity, such as a factory, a hospital, and a nursing home, the hair catcher 51 is located upstream of the filtering device 55 to remove typically hair from the bathwater.

The filtering device 55 has a filter tank 56 as is widely know. A plurality of tubular filters 57, 57, —, 57 is replaceably contained within the filtering device 56. A filtering-water supply pipe B and a filtered-water discharge pipe C are connected to the upper portion and lower portion of the filter tank 56, respectively. The filtered-water discharge pipe C is connected to the bottom portion of the antibacterial container 60 described later. While the filtering device 55 will not be further described in detail, any prior arts including Japanese Utility Model Laid-Open Publication No. Hei 6-48893, and Japanese Patent Laid-Open Publication No. Hei 9-142999, which have been proposed by the present applicant, may be applied.

The antibacterial container 60 has a tank 61 in which an antibacterial material or agent 63 and an active stone 62 is appropriately contained, in the present embodiment. The antibacterial agent 63 includes, but not limited to, Zeomix (trade mark). As the result of a verification test with respect to the effect of Zeomix by Mitsubishi Kagaku Bio-Clinical Laboratories, Inc., it has been proved that both minimum inhibitory concentration (i.e. minimum concentration of antibiotic substance or other antibacterial substance for blocking growth of microorganism) and minimal killing concentration (i.e. minimum concentration of antibacterial agent for showing antimicrobial activity) was equal to 125 ppm against Q252 strain of the common coliform bacteria and O157 strain of the Escherichia coliform bacteria. A specific amount of such an antibacterial agent 63 having an excellent antimicrobial activity is put into a net and then contained in the tank 61 together with the net, for example, in an upper internal space of the tank 61.

The active stone includes shell fossil and Bakuhan-stone. Such an active stone 62 includes: a natural mineral ore containing silic acid, aluminum oxide and the like as primary components, iron, manganese, magnesium, potassium, phosphor, titanium, and the like; or ceramics made from these materials. Active ingredients are dissolved from the active stone into the bathwater, so that hydrogen-ion concentration of the bathwater is controlled in alkalescent state. This provides a particular bath effect to the bathwater. Such an active stone is also put into a net and then contained in a lower inner space of the tank 61. An antibacterial-water discharge pipe D' is connected near the top of the tank 61, and is blanched into a main duct D and a sterilization bypass pipe E. A radium ore may be contained in the antibacterial container 60 to obtain the same effect as hot spring containing radium.

The silver ion generator 70 includes a silver ion electrode casing 71 and an electrode or cover 72 which fluid-tightly closes an opening portion of the silver ion electrode casing 71. The silver ion electrode casing 71 has a shape similar to a T or three-way joint, and is coupled to the antibacterial-water bypass pipe E by using two joint portions. An electrode of the silver ion generator 70 described later is replaceably located in an opening 71' corresponding to the remaining third joint portion. Since the silver ion electrode casing 71 is coupled with the antibacterial-water bypass pipe E, the bathwater may be flowed through the silver ion electrode casing 71 so as to mix silver ion into the bathwater only when the cascade pump 85 described later is operated. A silver pole of anode 73 is insulatively mounted to a back face, or a portion facing to the silver ion electrode casing 71, of the cover 72, and a net-like cathode 74 is insulatively mounted to the back face of the cover 72 with surrounding the anode 73. A pair of electrodes 73', 74' are mounted to a front face of the cover 72, and are electrically connected to the anode 73 and cathode 74, respectively. Positive and negative current sources of, for example, electrical equipment, are connected to one electrode 73' and another electrode 74', respectively.

The opening portion of the silver ion electrode casing 71 has an internal thread, but not shown, while the back face of the cover 72 has an external thread which is engaged with the internal thread of the silver ion electrode casing 71. Thus, the electrodes 73', 74' can be mounted to the silver ion electrode casing 71 only by screwing the external thread of the cover 72 into the internal thread of the casing 71, and can also be easily replaced together with the cover 72.

The cascade pump 85 comprises a centrifugal pump having numbers of vanes and is rotatably driven by a motor 86, as is widely known. A suction pipe H is connected to a suction port of the cascade pump 85. A discharge pipe 3 is connected to a discharge port of the cascade pump 85.

The ozone gas generator 80 is widely known. A check valve 82 is interposed in a gas supply pipe 81 which is opened at approximately central portion of the cascade pump 85. Thus, when the ozone gas generator 80 and the solenoid valve 84 are turned on during the operation of the cascade pump 85, an air supplied from an air supply pipe 83 and an ozone gas which is created by ozonizing part of the supplied air are sucked into a negative pressure area within the cascade pump 85.

The heat exchanger 90 is disposed in a return pipe K to which both the main duct D and the sterilization bypass pipe E are connected. The heat exchanger 90 of the present embodiment is configured as a heat-transfer tube type in which a plurality of heat-transfer tubes are, for example, provided between first and second headers 91, 92. A supply pipe 95 is connected to the first header 91 to supply a heating medium having a high temperature, and a discharge pipe 96 is connected to the second header 92 to discharge the heating medium the temperature of which is lowered by heat exchanging with the bathwater. The supply pipe 95 and discharge pipe 96 are connected with each other through a bypass pipe 98, and a three-way valve 97 is provided in the supply pipe 95, wherein the high temperature heat medium of the supply pipe 95 can be flowed directly to the discharge pipe 96 without passing through the heat exchanger 90. This allows only the bathroom YR to be heated.

According to the bathtub device 50 constructed as described above, the heat medium of water heated by the first heat exchanger 3 shown in FIG. 1 or by the bathtub heat exchanger 3" shown in FIG. 2 is provided to the heat exchanger 90 of the bathtub device 50 in the bathtub heating use. Then, the pump 54 of the bathtub device 50 is actuated. Thus, the bathwater in the bathtub Y is passed through a solenoid valve "v", the hair catcher 51, the filter tank 56, the antibacterial container 61, the main duct D and the heat exchanger 90, and then returned to the bathtub Y through the return pipe K. Subsequently, the bathwater will be circulated in the same way. Since the sterilization bypass pipe E has a relatively large flow resistance due to the presence of the silver ion generator 70, the cascade pump 85, and the like, the bathwater is directed to flow toward the main duct D having a small flow resistance. In the heat exchanger 90, a high-temperature heating medium is supplied to the first header 91 through the three-way valve 97. The high-temperature heating medium is flowed from the first header 91 to the second header 92 through the plurality of heat-transfer tubes. Hereat, the bathwater is flowed in the opposite direction with respect to the high-temperature heating medium and is thereby heated. The heating medium is lowered in temperature by heat exchanging, and then returned to the first heat exchanger 3 through the discharge pipe 96. Subsequently, the bathwater is heated up to a predetermined temperature by the heat exchanger 90.

During the circulation of the bathwater as described above, the hair catcher 51 removes relatively large foreign materials, such as hair, and the filter tank 56 removes relatively small solid materials. The antibacterial material 63 in the antibacterial container 60 sterilizes various bacteria, such as O157 strain of the Escherichia coliform bacteria. The active ingredients, such as magnesium, zinc, calcium and sodium, are dissolved from the active stone 62 into the bathwater as is widely known, so that hydrogen-ion concentration of the bathwater is controlled in an alkalescent state. This provides a particular bath effect to the bathwater. An organic matter in the bathwater is decomposed by bacteria which propagates itself in the active stone 62 and has heteronomy, so that the bathwater may be purified.

When the control device provided in the bathtub device 50 detects a predetermined sterilization time, the cascade pump 85 is activated. Simultaneously, switches of the silver ion generator 70 and ozone gas generator 80, the solenoid valve 84 and the like are turned on. In a predetermined ozone time, the pump 54 is also activated. Thus, when the bathwater is circulated as described above, a part of the bathwater is flowed into the main duct D and the remaining bathwater is flown into the sterilization bypass pipe E. In the silver ion generator 70, silver ion is mixed in the bathwater, so that various bacteria are sterilized. An ozone gas is sucked into the negative pressure area of the cascade pump 85 with air. The ozone gas including air is strongly mixed into the bathwater by an impeller of the cascade pump 85. While this ozone gas itself has a sterilizing effect, a synergy effect cased by the combination with the silver ion, which has been mixed into the bathwater in advance, enables more complete sufficient sterilization than that only by the ozone gas. The required amount of the silver ion can be reduced by virtue of the synergy effect on sterilization.

According to the present embodiment, the cathode 74 is configured in the form of a net or mesh to provide a wider area thereof, so that the efficiency of generating silver ion is enhanced. The net-like cathode 74 can also prevent a possible short circuit when the bathwater is passed through the silver ion electrode casing 71. A used-up electrode is replaced together with the cover 22.

The bathtub device 50 may be embodied in various forms or configuration without being limited to the illustrated embodiments. For example, it will be understood that the present invention can be equally implemented by using other arrangements of, for example, the circulating pump 54, the filtering device 55, the antibacterial container 60, the silver ion generator 70, the ozone gas generator 80, the cascade pump 85, and the heat exchanger 90, in a different manner from the illustrated embodiment. It is also apparent that the silver ion generator 20, the ozone gas generator 30, and the like may be manually switched.

Figure 5:
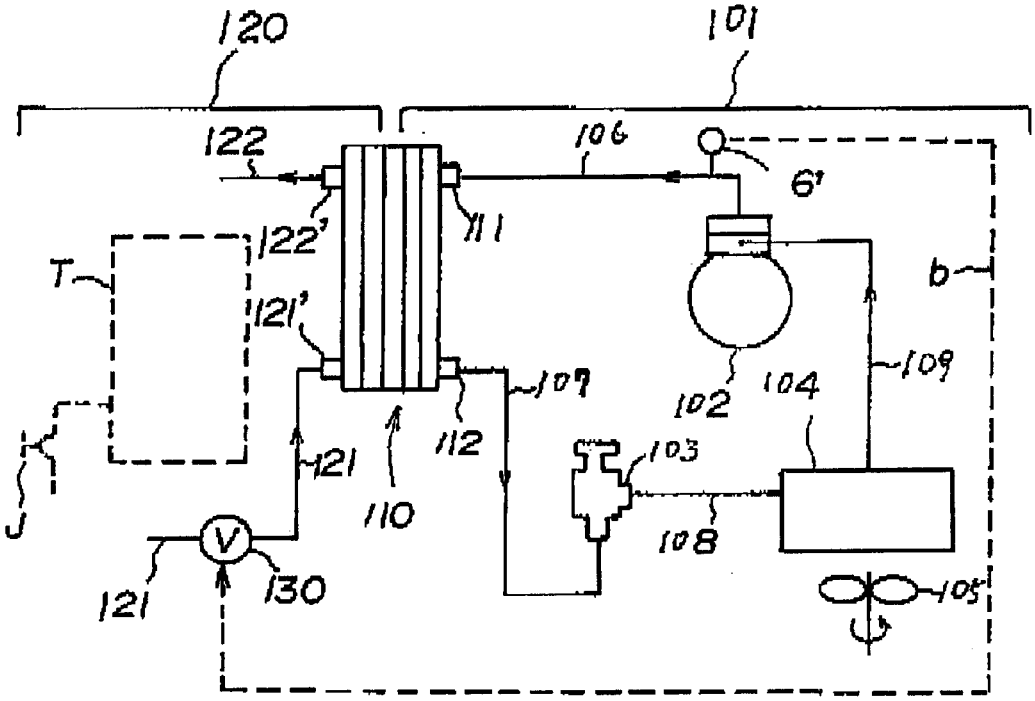
FIG. 5 is a schematic front view showing a fourth embodiment of the present invention.
Figure 6:
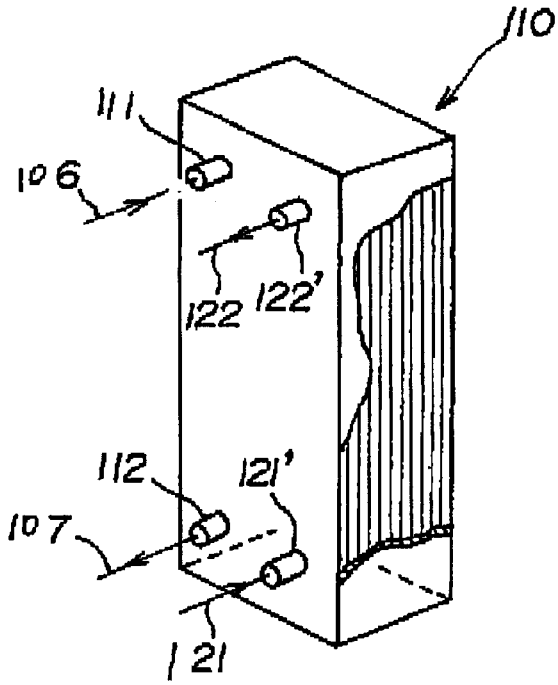
FIG. 6 is a perspective view showing a hot-water supply heat exchanger shown in FIG. 5, wherein a part of the heat exchanger is show in section.

With reference to FIGS. 5 to 8, fourth and fifth embodiments will be described hereinafter. FIG. 5 is a schematic front view showing the fourth embodiment of the present invention, and FIG. 6 is a perspective view of a feed-water heat exchanger. As shown in these drawings, a hot-water supply apparatus or heating apparatus having a refrigeration cycle according to the fourth embodiment includes a refrigeration cycle section 101 and a hot-water supply section 120. As is widely known, the refrigeration cycle section 101 includes a compressor 102, a hot-water supply heat exchanger 110 acting as a condenser, an expansion valve 103, an evaporator 104, and the like, which are connected by ducts 106, 107, 108, and 109 to make up a closed cycle. After going out of the compressor 102, a refrigerant, such as ammonia as an alternative to CFC, enters in the hot-water supply exchanger 110 through an inlet pipe 111 located on an upper region of one side of the hot-water supply exchanger 110, and then goes out of an outlet pipe 112 located on a lower region of the one side of the hot-water supply exchanger 110, followed by entering in the expansion valve 103 through a duct 107, whereafter the refrigerant passes through the evaporator 104 and the compressor 102, wherein the water or hot water is heated by latent heat of the refrigerant in the hot-water supply heat exchanger 110. A cooling fan 105 is additionally provided in association with the evaporator 104.

In the present embodiment, the hot-water supply heat exchanger 110 is a plate type heat exchanger. As shown in FIG. 6, the hot-water supply heat exchanger 110 has an approximately longitudinal cubic shape as a whole, and a plurality of plates are provided therein. A heating area and capacity of the hot-water supply heat exchanger 110 is appropriately selected by arranging parameters, such as area and number of the plates. The inlet pipe 111 for the refrigerant and an outlet pipe 122' for water or hot-water are located on an upper region of the hot-water supply exchanger 110, while the outlet pipe 112 for the refrigerant and an inlet pipe 121' for the water or hot-water are located on a lower region thereof. The structure of the hot-water supply heat exchanger 110 will not be further described in detail because it is common knowledge.

The hot-water supply section 120 comprises a feed water pipe 121 connected to, for example, a city water pipe, and a tapping water pipe 122. The feed water pipe 121 and tapping water pipe 122 are connected to the inlet pipe 121' and outlet pipe 122' of the hot-water supply heat exchanger 110, respectively. A pressure-type temperature regulating valve 130 is provided in the feed water pipe 121. The pressure-type temperature regulating valve 130 is electrically connected to a pressure sensor 6' attached in a discharge duct 106 of the compressor 102, by a signal line "b". This allows an opening of the pressure-type temperature regulating valve 130 to be controlled in response to a pressure of the refrigerant during operation. In other words, the amount of supply water or tapping water is controlled in response to pressure fluctuation of the machine or refrigerant depending on boundary conditions, such as outside air temperature.

Operations of the fourth embodiment will be described hereinafter. The refrigeration cycle section 101 is activated. Then, the refrigerant is circulated through the compressor 102, the hot-water supply heat exchanger 110, the expansion valve 103, the evaporator 104, and the compressor 102, in this order. During this time, the refrigerant is changed in its state from gas to liquid at the hot-water supply heat exchanger 110 wherein the refrigerant releases a latent heat. Since parameters, such as heating area and size, of the hot-water supply heat exchanger 110 are appropriately selected, hot water or tapping water of 70° C. or more can be obtained with about relatively low condensing pressure of 2.15MPa and a supercooling temperature of 30° C. or more which is very high as compared with 5° C. in conventional refrigeration cycles when the feed water in is supplied to the hot-water supply heat exchanger 110 after the flow rate of the feed water is adjusted by the pressure-type temperature regulating valve 130.

According to the present embodiment, the obtained hot water has a high temperature, such as 70° C. or more. Thus, the obtained high temperature water may be stored in a hot-water storage tank T and may, as needed, be used by turning on a tap J to mix with cold water, as shown by the chain line in FIG. 5. In this case, the hot-water storage tank T may be advantageously small in volume due to the stored high temperature water. While the pressure-type temperature regulating valve 130 is interposed in the feed water pipe 121 in the present embodiment, it may be provided in the tapping water pipe 122. It will be understood that hot water having a similar high temperature can be obtained if the pressure-type temperature regulating valve 130 is provided in the tapping water pipe 122. Since the pressure-type temperature regulating valve 130 is provided to control the amount of the tap water in response to pressure fluctuation of the machine or refrigerant depending on boundary conditions, such as outside air temperature, it will also be understood that any flow control valve capable of regulating the amount of the supply water or tap water manually or in response to outside air temperature may, for example, be in substitution for the pressure-type temperature regulating valve 130. The reason for obtaining such high temperature water is unknown.

Figure 8:
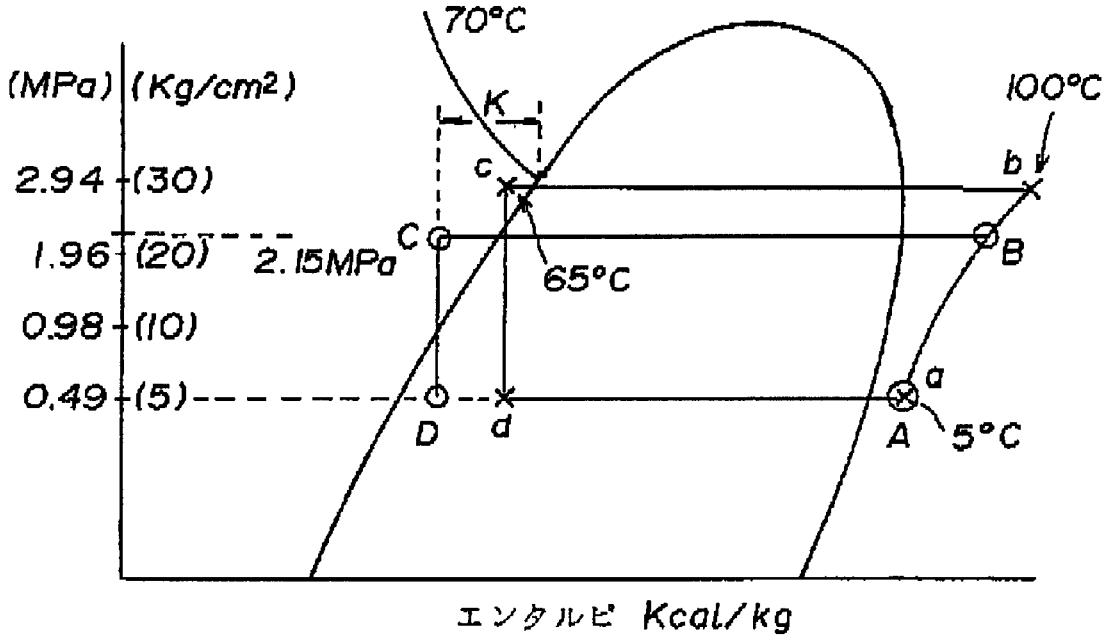
FIG. 8 is a Mollier chart showing a refrigerant flow in the fourth and fifth embodiments of the present invention.
Figure 9:
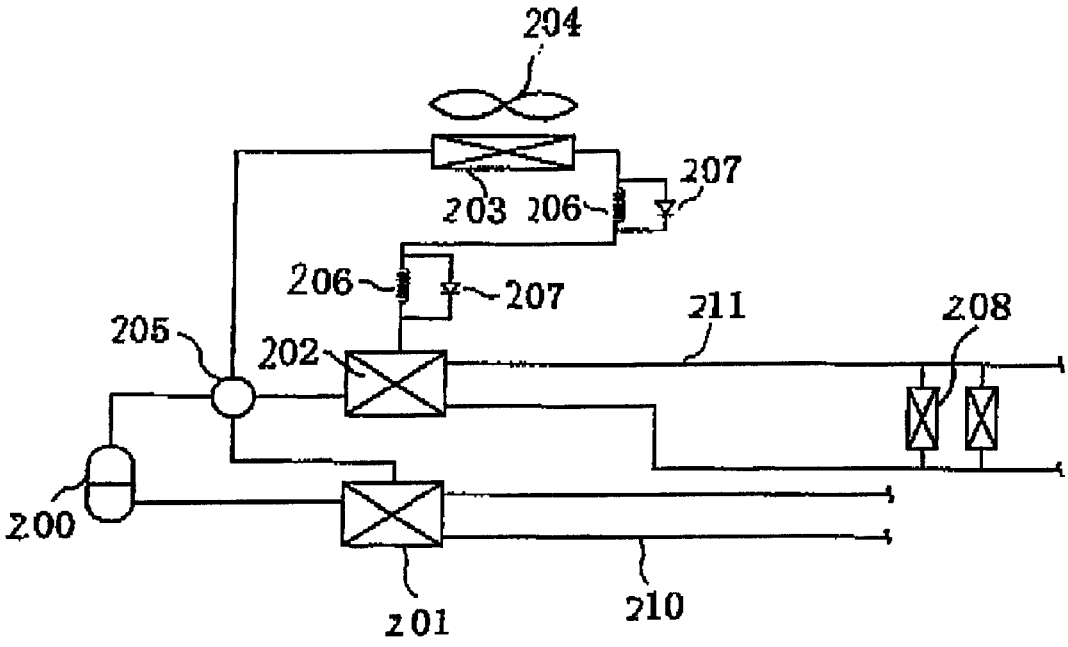
FIG. 9 is a circuit diagram showing a conventional heating apparatus.

However, it is believed that broadening the heating area and enlarging the capacity, or volume, of the hot-water supply heat exchanger 110 allows the hot-water supply heat exchanger 110 to have a longer period for heat exchanging with gaseous refrigerant, and thereby allows the refrigerant to be sufficiently condensed to obtain larger supercooling, which enables to obtain high temperature water, such as 70° C. or more with low condensing pressure, such as 2.15MPa. Another assumable theory will be described as follows. FIG. 8 is a Mollier chart showing a refrigerant flow. In the conventional apparatuses, when it is required to obtain hot water of 70° C. by supplying supply water of 65° C. to the hot-water supply heat exchanger, the refrigerant flow is represented as "a", "b", "c", "d", "a" in FIG. 8, and the condensing pressure comes to about 2.94MPa (30 kg/cm2). This pressure value exceeds an allowable withstand pressure of the machine which is usually stopped for safety's sake at 2.7 MPa (28 kg/cm2). Thus, it cannot actually obtain hot water of 70° C. In contrast, according to the present embodiment, the condensing pressure may be lowered to about 2.15MPa and water of 70° C. may be obtain by enlarging the supercooling temperature K and broadening the heating area of the hot-water supply heat exchanger, more than that required for regular condensers, for example twice, as shown in FIG. 8. This refrigerant flow is indicated by "A", "B", "C", "D", "A". The supercooling may be increased by various fashions, for example, bay making the refrigerant pass through the condenser twice.

Figure 7:
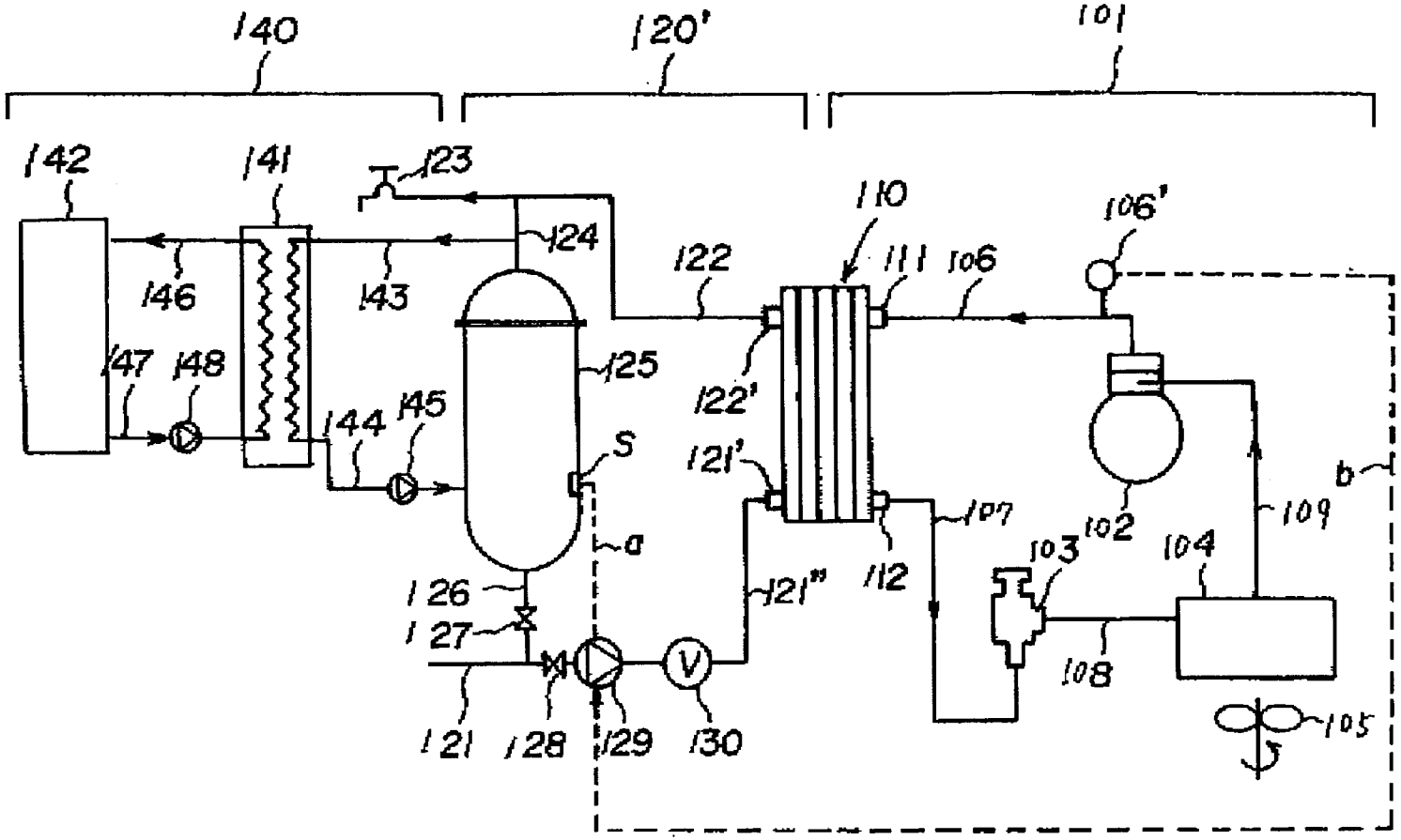
FIG. 7 is a schematic front view showing a fifth embodiment of the present invention.

With reference to FIG. 7, a fifth embodiment will be described hereinafter. In FIG. 7, the same elements of structure as those of the fourth embodiment shown in FIG. 5 are identified by the same reference numerals, the similar elements being identified by adding dash to the same reference numerals, and their description will be omitted. According to the fifth embodiment, a hot-water supply apparatus comprises the refrigeration cycle section 101, a hot-water supply section 120', and a heat load section 140. The hot-water supply section 120' includes a hot-water storage tank 125. A lower region of the hot-water storage tank 125 and the feed water pipe 121 are connected with each other through a duct 126 in which the first control valve 127 is interposed. A second control valve 128 and a pump 129 are interposed in the feed water pipe 121. The feed water pipe is then extended as a secondary feed water pipe 121" which is connected to an inlet pipe 121'. A branch pipe 124 branched from the tapping water pipe 122 is connected to an upper region of the hot-water storage tank 125. A temperature sensor S is attached in the lower region of the hot-water storage tank 125. The temperature sensor S and the pump 129 are electrically connected with each other through a signal line "a" so that the pump 129 may be activated and the hot water in the hot-water storage tank 125 may be circulated to be heated when the temperature sensor S detects that a water temperature in the hot-water storage tank 125 decreases to a predetermined temperature or less. The heat load section 140 comprises a heat exchanger 141, and a heat consumption part 142, such as a bathtub, a heater, and a dryer. The heat exchanger 141 and the hot-water storage tank 125 are connected to each other through a primary hot-water supply pipe 143 and a primary hot-water return pipe 144. The heat exchanger 141 and the heat consumption part 142 are connected to each other through a secondary hot-water supply pipe 146 and a secondary hot-water return pipe 147. Thus, when a first pump 145, interposed in the primary hot-water return pipe 144 is activated the hot-water having a relative high temperature in the hot-water storage tank 125 is circulated between the hot-water storage tank 125 and the heat exchanger 141. When a second pump 148 interposed in the secondary hot-water return pipe 147 is activated, a heating medium, such as water or hot water, filled in the secondary hot-water supply pipe 146 and the secondary hot-water return pipe 147 is circulated between the heat exchanger 141 and the heat consumption part 142.

The fifth embodiment configured as described above can perform the following various heating.

(a) Case for Obtaining Hot Water Directly.

Assuming that the hot-water storage tank 125, the primary hot-water supply pipe 143, the primary hot-water return pipe 144, and the like are filled with hot water. The refrigeration cycle is activated. The first control valve of the duct 126 is closed, while the second control valve 128 of the feed water pipe 121 is opened, and a tap 123 of the tapping water pipe 122 is opened. The pressure-type temperature regulating valve 130 is adjusted. Then, the pump 129 is activated. Consequently, a cold water supplied from the feed water pipe 121 is adjusted in an adequate flow rate by the pressure-type temperature regulating valve 130, and then provided to the hot-water supply heat exchanger 110. In the hot-water supply heat exchanger 110, the provided water is heat exchanged with the refrigerant of the refrigeration cycle section 101 to heat up to high temperature, such as 70° C., and then discharged to the tapping water pipe 122, as described above. Since the hot-water storage tank 125, the primary hot-water supply pipe 143, the primary hot-water return pipe 144, and the like has a fluid resistance due to the filled hot water therein, the heated water is discharged from the tap 123. Thus, a high temperature tapping water can be obtained directly. In cases where a control valve is provided in the branch pipe 124, the primary hot-water supply pipe 143, or the like, it is apparent that the control valve may be closed when the tapping water is supplied directly.

(b) Case for Taking a Tapping Water from the Hot-water Storage Tank 125.

The feed water tank 125 is now filled with hot water. The first control valve 127 of the duct 126 is adjusted in an adequate opening, and the second control valve 128 of the feed water pipe 121 is closed. Then, a cold water is supplied from the feed water pipe 121 to the hot-water storage tank 125. Thus, the hot water in the hot-water storage tank 125 is pushed up by the supplied cold water. Since the primary hot-water supply pipe 143, the primary hot-water return pipe 144, and the like has a fluid resistance due to the filled hot water therein, the forced high temperature water in the hot-water storage tank 125 may be discharged from the tap 123.

(c) Case for Circulating and Heating the Hot Water in the Hot-water Storage Tank 125.

When the temperature sensor S detects that a water temperature in the hot-water storage tank 125 decreases to a predetermined temperature, for example 50° C. or less, the pump 129 is activated. The lower hot water in the hot-water storage tank 125 is passed through the first and second control valves 127, 128, and adjusted by the pressure-type temperature regulating valve 130. Then, the hot water is provided to the hot-water supply heat exchanger 110. The provided hot water is heat exchanged with the refrigerant of the refrigeration cycle section 101 to heat up to a high temperature at the hot-water supply heat exchanger 110 as described above, and the heated water is returned from the branch pipe 124 to the hot-water storage tank 125 so that the heated high temperature water may be stored in turn from the upper side of the hot-water storage tank 125. Subsequently, the hot water in the hot-water storage tank 125 is circulated and heated in the same way. When the temperature sensor S detects that the water temperature in the hot-water storage tank 125 reaches the predetermined temperature, the pump 129 is stopped.

(d) Case for Heating the Heat Consumption Part 142.

The first and second pumps 145, 148 of the primary and secondary hot-water return pipes 144, 147 are activated. Then, the hot water in the hot-water storage tank 125 is circulated through the primary hot-water supply pipe 143, the heat exchanger 141, the primary hot-water return pipe 144, and the hot-water storage tank 125, in this order. For example, hot water as a heating medium where the heat consumption part is a floor heating device, or bathwater where the heat consumption part is a bathtub is circulated through the heat exchanger 141, the secondary hot-water supply pipe 146, the heat consumption part 142, the secondary hot-water return pipe 147, and the heat exchanger 141, in this order. The hot water, or the bathwater, as a heating medium, or the bathwater is heated in the heat exchanger 141 and then its heat is dissapated in the heat consumption part 142. This enables the heat consumption part 142 to be heated. When the temperature of the hot water in the hot-water storage tank 125 is decreased in connection with the heating of the heat consumption part 142, the refrigeration cycle section 101 and the pump 129 are simultaneously activated so that the hot water in the hot-water storage tank 125 is circulated and heated as described above. A filtering device, an active stone, a sterilization device, and the like, described in Japanese Patent Laid-Open Publication No. Hei 7-21195 and Hei 10-314255, which are proposed by the present applicant, may be incorporated in such a bath-water circulation/heating arrangement.

It will be understood that the fifth embodiment may perform heating in various combinations other than the foregoing. For example, when the hot water in the hot-water storage tank 125 is supplied and decreased by a predetermined amount, the hot water may be heated directly. It is also apparent that the hot water of the hot-water storage tank 125 may be discharged to the tap 123 by supplying a cold water through the first control valve 127 to the hot-water storage tank 125, when the hot water in the hot-water storage tank 125 is being circulated for heating. Further, it is apparent that the hot-water storage tank 125 may be an open type tank.

TEST EXAMPLE 1

A hot-water supply apparatus as shown in FIG. 7 was put to the test, where the compressor capacity was 3 horsepower, the hot-water supply heat exchanger was a plate type (number of plate: 50) having 1.2 $mm^2$ of heating area (outside dimension: 103 mm width, 135 mm depth, 302 mm height) and 1.4 liter of volume. Tapping water of 70° C. could be obtained with the outside air temperature under 6° C. The amount of the feed water (tapping water) regulated by the pressure-type temperature regulating valve was 161 liter/hour. The condensing pressure was 2.1MPa. In the test where the temperature of the feed water was 51° C. or less, tapping water of 60° C. could be obtained without any problem.

TEST EXAMPLE 2

The same hot-water supply apparatus as Test Example 1 was put to the test, where the compressor capacity was 3 horsepower as same as Test Example 1, the hot-water supply heat exchanger was a plate type (number of plate: 30) having 1.76 $mm^2$ of heating area (outside dimension: 125 mm width, 85 mm depth, 532 mm height) and 2.0 liter of volume. Tapping water of 71° C. could be obtained with the outside air temperature under 10° C. and the feed water under 20° C. The amount of the feed water (tapping water) regulated by the pressure-type temperature regulating valve was 197 liter/hour. The condensing pressure was 2.15 MPa. In the test where the temperature of the feed water was 51° C. or less, there was no problem.

From the results of the above Test Examples 1, 2, it was inferable that the heating area or capacity of the hot-water supply heat exchanger and the amount of the water or hot water supplied to the hot-water supply heat exchanger had a strong relationship with the obtained water temperature, and the period for heat exchanging with the gaseous refrigerant at the hot-water supply heat exchanger, the condensing level of the refrigerant, the amount of supercooling, and the like had much effect on the obtained water temperature. Thus, it was proved that 60° C. or more hot water could be obtained without increased condensing pressure, by selecting the above relationship adequately. In addition, it was proved that the hot water of 51° C. or less could be supplied to the hot-water supply heat exchanger even if the water temperature supplied to the hot-water supply heat exchanger was raised in conjunction with the foregoing.

What is claimed is:

1. A heating apparatus having a refrigeration cycle which includes a compressor, a condenser and an evaporator connected in a circuit for circulating a refrigerant, said heating apparatus comprising:

a first heat exchanger and a second heat exchanger connected in heat transfer relation with said refrigerant in said refrigerant circulating circuit to operate selectively as a condenser or an evaporator, wherein said first heat exchanger is selected as a heat source, said second heat exchanger is selected as either a cooling or heating source, said first heat exchanger and second heat exchanger being connected in series with each other in the refrigerant circuit; and a heat transfer device in which a heating medium is circulated and which is connected in heat transfer relation to said first heat exchanger, wherein bathwater of a bathtub and water of a hot-water storage tank are heated through said heat transfer device indirectly by said first heat exchanger.

2. A heating apparatus as defined in claim 1, further comprising a bathroom heating device connected in heat transfer relation to said refrigerant circuit in said heat transfer device, and a cooling/heating device and a floor heating device which are connected in heat transfer relation to said refrigerant circuit in said second heat exchanger.

3. A heating apparatus as defined in claim 1 or 2, further comprising a bathtub device which is interposed between said heat transfer device and said bathtub, said bathtub device includes a filtering/purifying device for the bathwater, and a heat exchanger for exchanging heat between said heat transfer device and the bathwater.

4. A heating apparatus having a refrigeration cycle which includes a compressor, a condenser and an evaporator connected in a circuit for circulating a refrigerant, said heating apparatus comprising:

a first heat exchanger, a second heat exchanger, and a third heat exchanger connected in heat transfer relation with said refrigerant in said refrigerant circulating circuit to operate selectively as a condenser or an evaporator, wherein said first and second heat exchangers are respectively selected as a heat source, said third heat exchanger being selected as either a cooling or a heating source, said first and second heat exchangers being connected in series with said third heat exchanger in a refrigerant circuit; and a heat transfer device in which a heating medium is circulated and which is connected in heat transfer relation respectively to said first heat exchanger and said second heat exchanger, wherein bathwater of a bathtub and water of a hot-water storage tank are independently heated through said heat transfer device indirectly by said first heat exchanger and said second heat exchanger, respectively.

5. A heating apparatus as defined in claim 4 further comprising a bathroom heating device connected in heat transfer relation to said refrigerant circuit in said heat transfer device, and a cooling/heating device and a floor heating device which are connected in heat transfer relation to said refrigerant circuit.

6. A heating apparatus having a refrigeration cycle which includes a compressor, a condenser, and an evaporator, wherein a hot water supply heat exchanger to which a feed water pipe and a tapping water pipe are connected operates as said condenser, the heating apparatus comprising:

a flow regulating valve interposed in either one of said feed water pipe and said tapping water pipe, wherein tap water of 60° C. or more is obtained with a condensing pressure of an allowable pressure or less by determining a parameter of the refrigeration cycle including the feed water flow rate depending on said flow regulating value, a heating area and size of said hot-water supply heat exchanger, and a supercooling rate.

7. A heating apparatus having a refrigeration cycle which includes a compressor, a condenser and an evaporator, wherein a hot water supply heat exchanger to which a feed water pipe and a tapping water pipe are connected operates as said condenser, said heating apparatus comprising:

a flow regulating valve interposed in either one of said feed water pipe and said tapping water pipe, wherein tap water of 35° C. or more is supplied to said hot-water supply heat exchanger with a condensing pressure of an allowable pressure or less, and tapping water of 60° C. or more is obtained by determining a parameter of the refrigeration cycle including the feed water flow rate depending on said flow regulating valve, a heating area and size of said hot-water supply heat exchanger and a supercooling temperature.

8. A heating apparatus having a refrigeration cycle which includes a compressor, a condenser and an evaporator, wherein a hot-water supply heat exchanger to which a hot-water storage tank is connected through a feed water pipe and a tapping water pipe operates as said condenser, said heating apparatus comprising:

a flow regulating valve interposed in either one of said feed water pipe and said tapping water pipe, wherein hot water in said hot-water storage tank is circulated between said hot-water storage tank and said hot-water supply heat exchanger when water temperature detected in said hot-water storage tank drops to a predetermined temperature or less, and hot water of 60° C. or more is obtained with a condensing pressure of an allowable pressure or less by determining a parameter of the refrigeration cycle including the feed water flow rate depending on said flow regulating valve, a heating area and size of said hot-water supply heat exchanger and a supercooling temperature.

9. A heating apparatus as defined in claim 8 further comprising a heat load device which serves uses including bathwater, heating, and drying.

10. A heating apparatus as defined in any one of claims 6 to 9, wherein said flow regulating valve is a pressure type temperature regulating valve for controlling the feed water flow rate by sensing a pressure of the refrigerant in the refrigeration cycle.

* * * * *